US011598349B2

(12) United States Patent
Kanematsu

(10) Patent No.: US 11,598,349 B2
(45) Date of Patent: Mar. 7, 2023

(54) CEILING-INSERTED FAN

(71) Applicant: Panasonic Intellectual Property Management Co., Ltd., Osaka (JP)

(72) Inventor: Daisuke Kanematsu, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 17/665,650

(22) Filed: Feb. 7, 2022

(65) Prior Publication Data

US 2022/0268297 A1 Aug. 25, 2022

(30) Foreign Application Priority Data

Feb. 19, 2021 (JP) ..... JP2021-024912

(51) Int. Cl.
*F04D 29/42* (2006.01)
*F04D 29/08* (2006.01)
*F04D 17/08* (2006.01)

(52) U.S. Cl.
CPC ..... *F04D 29/4226* (2013.01); *F04D 17/08* (2013.01); *F04D 29/083* (2013.01)

(58) Field of Classification Search
None
See application file for complete search history.

(56) References Cited

FOREIGN PATENT DOCUMENTS

| | | | | |
|---|---|---|---|---|
| JP | H03-097141 | U | | 10/1991 |
| JP | H09137987 | A | * | 4/1994 |
| JP | H08271006 | A | * | 10/1996 |
| JP | H0694279 | A | * | 5/1997 |
| JP | 2019138595 | A | * | 8/2019 |
| WO | 2018/220697 | A1 | | 12/2018 |

* cited by examiner

*Primary Examiner* — Michael Lebentritt
(74) *Attorney, Agent, or Firm* — Renner, Otto, Boisselle & Sklar, LLP

(57) ABSTRACT

A ceiling-inserted fan includes a case having an air inlet on a bottom surface of the case and an air outlet on a side surface of the case, an adapter plate having a rectangular opening and forming at least part of the side surface of the case, a duct-connecting adapter protruding outward the adapter plate and an air-sending part for directing air from the air inlet to the air outlet. The duct-connecting adapter is separated from the adapter plate and includes a sealing section that contacts with a peripheral section of the rectangular opening inside the case and a locking section that contacts with the peripheral section of the rectangular opening outside the case. The sealing section and the locking section removably holds the peripheral section.

7 Claims, 20 Drawing Sheets

CEILING-INSERTED FAN

TECHNICAL FIELD

The present prevention relates to a ceiling-inserted fan to be installed in a ceiling and any other location of a building.

BACKGROUND ART

A ceiling-inserted fan is generally supported by robust stringpieces referred to as joists to be installed in a ceiling. There have been two different construction methods to install the ceiling-inserted fan, one is to first install the fan to the joists, then construct a ceiling board, or the other is to previously provide an opening on an existing ceiling board, then install the fan. In either case, a mounting bracket, which may come with the fan, is screwed to the joists first, then an adapter set is attached to the mounting bracket. Subsequently, a case of the ceiling-inserted fan is slid and fitted to the adapter set, then they are integrated with screws and/or any other fasteners.

Some building constructors or some areas require the ceiling-inserted fan to have incombustibility for installation in buildings. In these buildings, exposed portions except a duct-connecting adapter of the adapter set need to be metal excluding very small parts. In this case, the duct-connecting adapter is generally fixed to a periphery of an adapter plate with screws and/or any other fasteners, spotwelding, or caulking.

PTL 1 discloses a conventional ceiling-inserted fan. For the conventional ceiling-inserted fan, an adapter integrated with an adapter plate is screwed to a case of a fan.

The conventional ceiling-inserted fan is explained with reference to FIG. 19.

The conventional ceiling-inserted fan is installed in an attic and any other location of the building. Adapter set 104 is composed of adapter plate 102 and adapter 103 made of generally metal or resin. Adapter set 104 is screwed to a periphery of case 101 having an air outlet on a side surface of the case.

Apart from the conventional ceiling-inserted fan described above, PTL 2 discloses another conventional ceiling-inserted fan. For the other ceiling-inserted fan, an adapter is screwed to an adapter plate.

The other conventional ceiling-inserted fan is explained with reference to FIG. 20.

The other conventional ceiling-inserted fan is also installed in the attic and any other location of the building. Adapter 202 made of metal or resin is first screwed to adapter plate 203 made of generally metal, then an assembly of these components is screwed to an unillustrated case having an air outlet on a side surface.

CITATION LISTS

Patent Literatures

PTL1: Utility Model Application Publication No. H3-97141
PTL2: International Unexamined Patent Application No. 2018/220697

SUMMARY OF THE INVENTION

Unfortunately, for the conventional ceiling-inserted fan, adapter 103 integrated with adapter plate 102 is only screwed to a periphery of a case of a ceiling-inserted fan and there exists a gap between adapter set 104 and the case. The gap causes air leakage into an attic, particularly in upper floors of a building subject to exhaust back pressure or in buildings where exhaust ducts are complicatedly bent, therefore, there has been a desire to improve the gap.

Here, a structure in FIG. 20, where the adapter is screwed to the adapter plate, is still applicable as means for clearing the gap between them and preventing air leakage.

Unfortunately, the structure described above limits the number of construction methods. This means, as described above, to support a weight of the ceiling-inserted fan by robust stringpieces referred to as joists, a mounting bracket is screwed to the joists, then the assembly of the adapter and the adapter plate is fixed to the mounting bracket, finally the case of the ceiling-inserted fan is slid and fitted to the assembly to integrate them with the screws. However, in this case, the adapter is screwed to a periphery of the adapter plate, therefore, screw points penetrate through the adapter plate and protrude inside the adapter plate. Resultantly, it is difficult to slide and fit the case to the assembly not only because the screw points are obstructive but also because the adapter includes a portion protruding inside the case.

As such, the conventional ceiling-inserted fans have had problems such that air leaks from the gap between the case and the adapter integrated with the adapter plate, or it is difficult to slide and fit the case to the assembly of the adapter and the adapter plate to integrate them in terms of workability.

Thus, the present invention intends to provide a ceiling-inserted fan capable of preventing air leakage and loss of workability where an assembly of an adapter and an adapter plate is separated from a case of the fan.

DESCRIPTION OF THE EMBODIMENTS

Hereinafter, embodiments of the present invention will be explained with reference to the accompanying drawings. Note that each of the embodiments explained hereinafter shows a specific example of the present invention and should not be construed to limit the technical scope of the present invention. The same symbols are used for the components that are substantially the same each other and the repetitive explanation thereof may be omitted or simplified throughout the drawings.

First Embodiment

Figure 1:
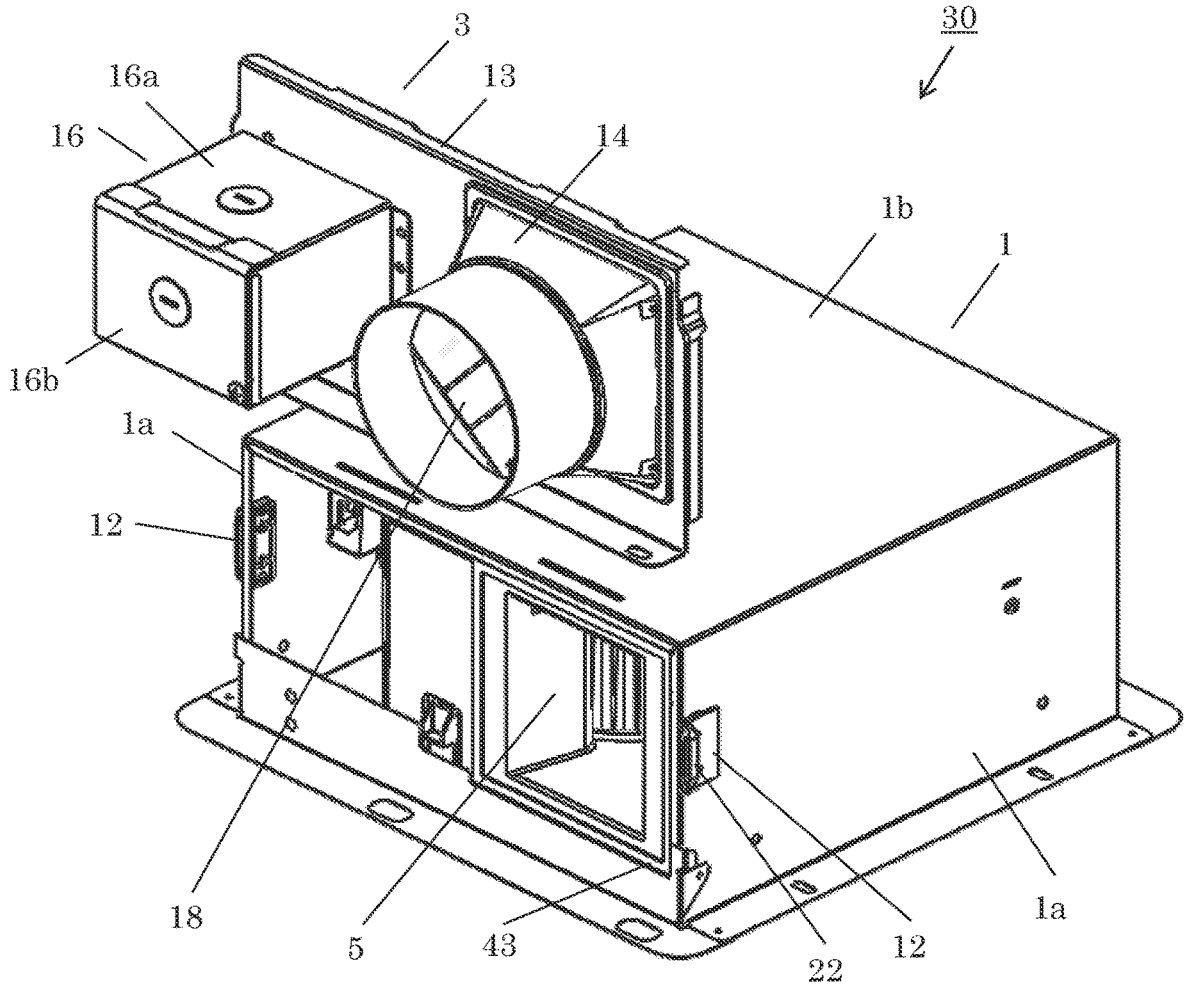
FIG. 1 is an exploded perspective view of a ceiling-inserted fan in accordance with the present invention.
Figure 2:
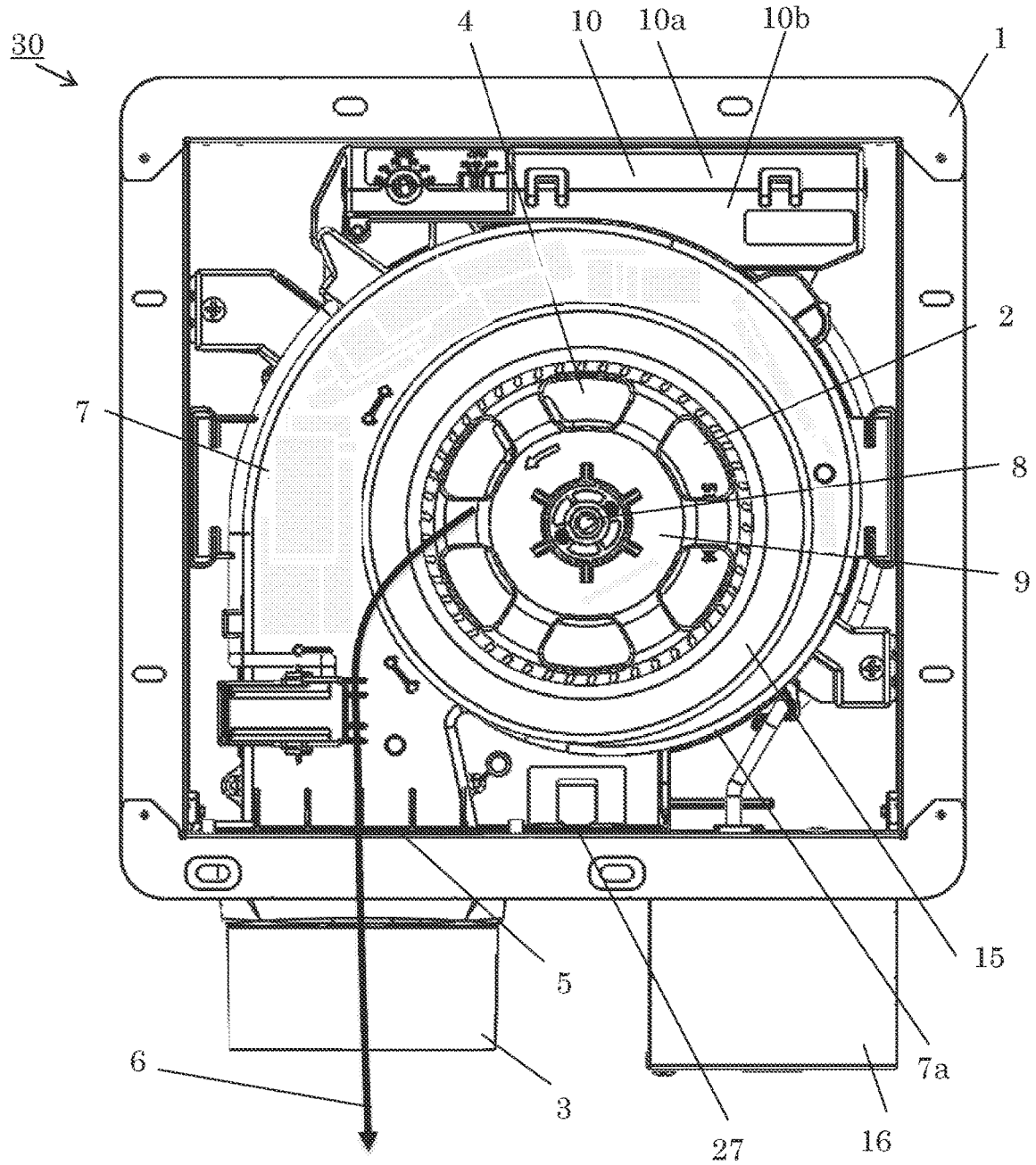
FIG. 2 is a bottom view of the ceiling-inserted fan.
Figure 3:
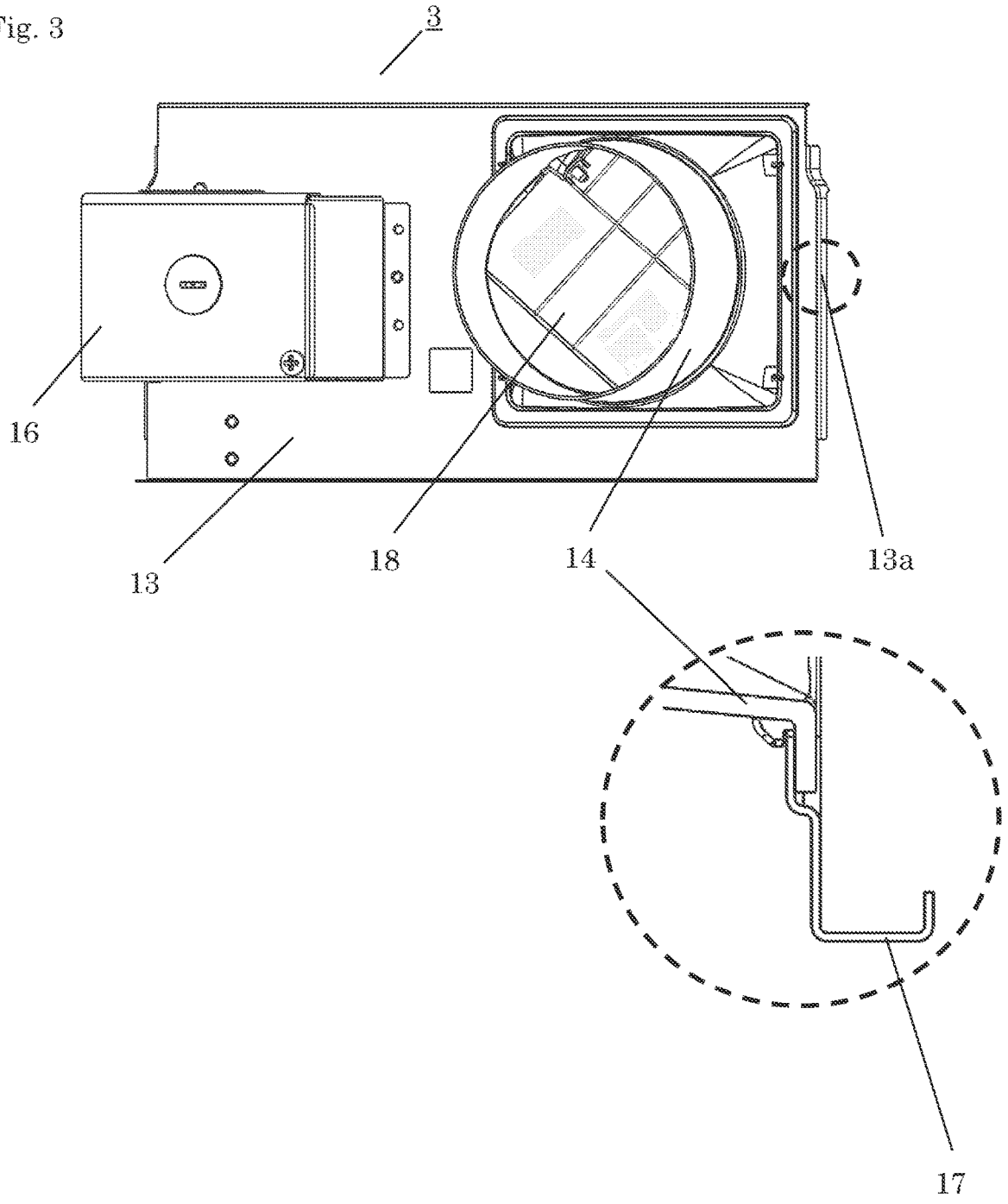
FIG. 3 is a side perspective view of an adapter set.
Figure 4:
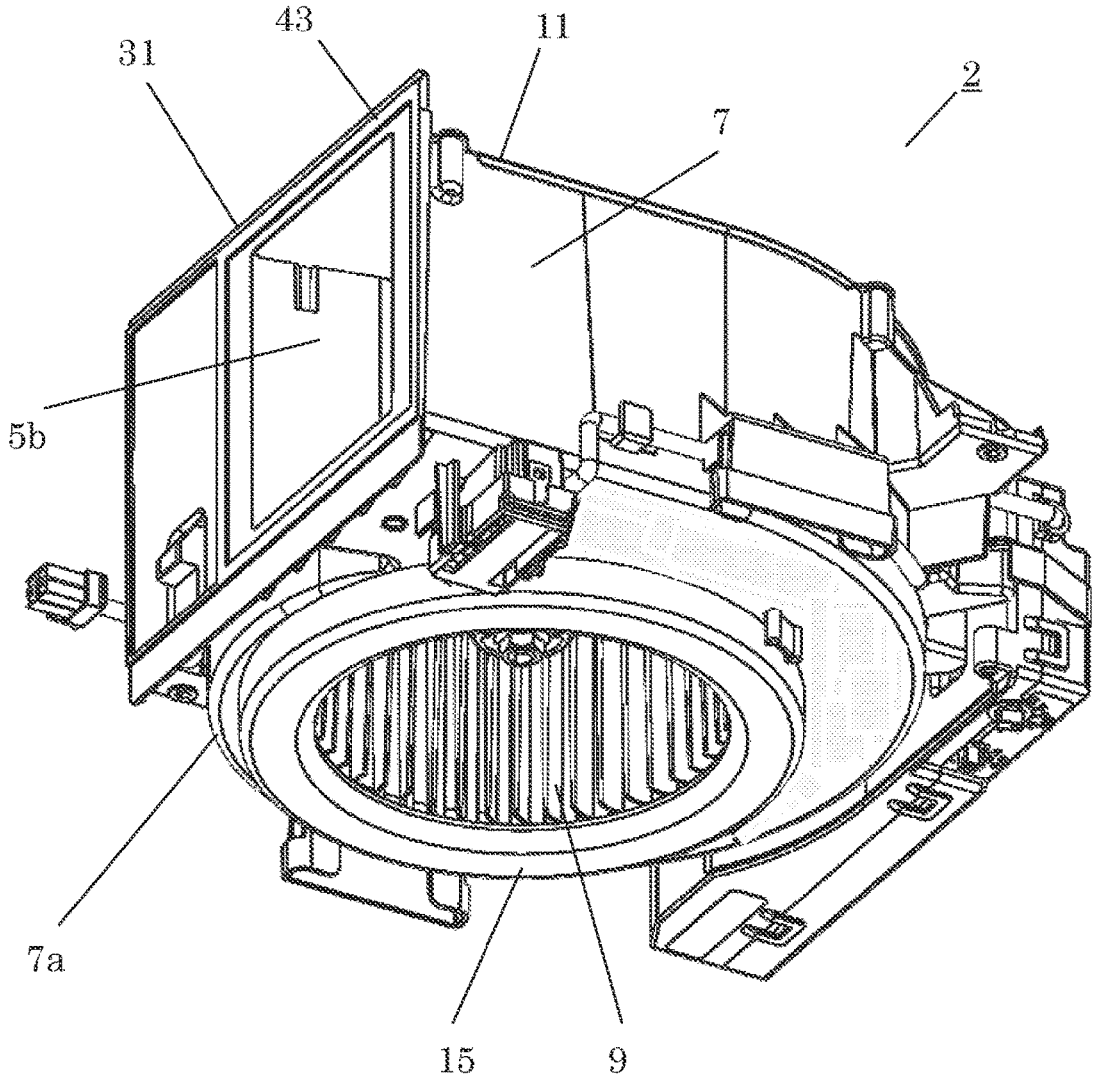
FIG. 4 is a perspective view of an air-sending part.
Figure 5:
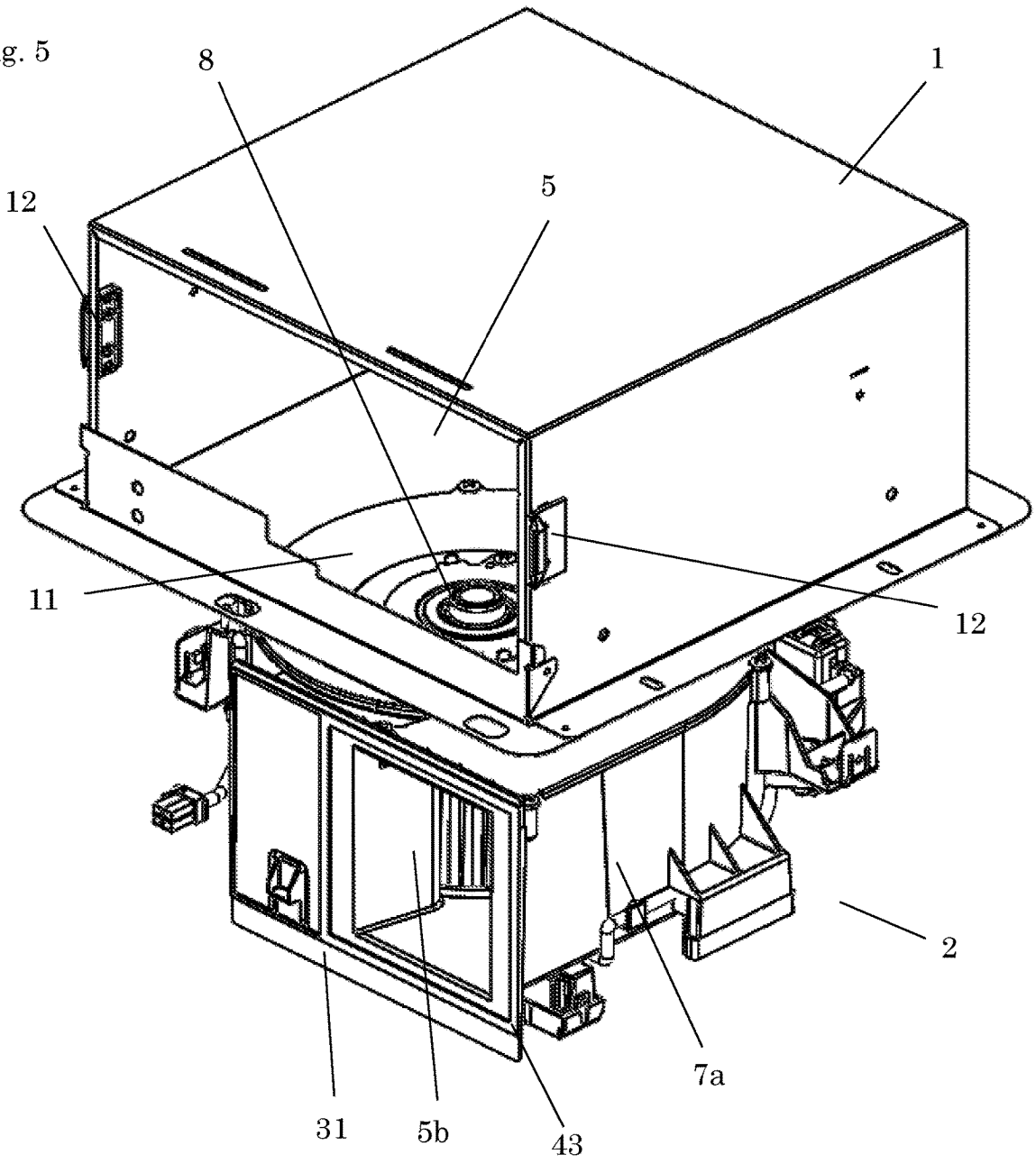
FIG. 5 is an exploded perspective view of a case and the air-sending part.

A structure of ceiling-inserted fan 30 in accordance with the embodiment 1 of the present invention is explained with reference to FIG. 1, FIG. 2, FIG. 3, FIG. 4, and FIG. 5. FIG. 1 is an exploded perspective view of ceiling-inserted fan 30 in accordance with the present invention. FIG. 2 is a bottom view of ceiling-inserted fan 30. FIG. 3 is a side perspective view of adapter set 3. FIG. 4 is a perspective view of air-sending part 2. FIG. 5 is an exploded perspective view of case 1 and air-sending part 2.

Ceiling-inserted fan 30 in accordance with the present invention includes case 1, air-sending part 2 and adapter set 3.

Case 1 is a box-shaped component made of metal with at least a side surface open. Case 1 includes air inlet 4, air outlet 5 and guide members 12.

Air inlet 4 is vertically directed to a ground surface with ceiling-inserted fan 30 installed in a ceiling, and air inlet 4 is an opening of case 1. Air is supplied into case 1 via an unillustrated design panel.

Air outlet 5 is disposed as an opening on one of the side surfaces of case 1. The side surface is adjacent to a bottom surface where air inlet 4 is disposed. Air outlet 5 is a whole area of the side surface of case 1, however, air practically passes only through air outlet 5*b*, which is an opening disposed on air-sending part 2.

Air inlet 4 and air outlet 5 are communicated with each other inside case 1 and an air way between them serves as exhaust path 6.

Case 1 includes each of guide members 12 on each of adjacent side surfaces 1*a* adjacent to air outlet 5.

Each of guide members 12 is a rectangular protrusion made of resilient resin, which is disposed on a periphery of case 1. Each of guide members 12 has bulging section 22.

Bulging section 22 is a part that bulges outward from adjacent side surface 1*a*. Bulging section 22 is arched at the center on a long side of each of guide members 12 to be engaged with each of concave shapes 17 of adapter plate 13. This means each of guide members 12 is in sliding relationship with each of guide supporting sections 13*a* described later. Case 1 vertically guides adapter set 3 as well as prevents air outlet 5 from shifting too far. Adapter plate 3 includes guide supporting sections 13*a* each disposed at both short ends of adapter plate 3 in the embodiment.

Each of guide supporting sections 13*a* is formed by folding each of the both short ends of adapter plate 13 two times. Specifically, each of the short ends is first folded to be parallel to each of adjacent side surfaces 1*a*, then again folded inward to be parallel to adapter plate 13. Each of guide supporting sections 13*a* has concave shape 17 when adapter set 3 is viewed from above (when FIG. 1 is viewed from above). Case 1 is fitted to adapter set 3 by vertically sliding each of guide members 12 disposed in each of adjacent side surfaces 1*a* into each of inner walls of concave shapes 17.

Air-sending part 2 is disposed in exhaust path 6 to direct air from air inlet 4 to air outlet 5. Air-sending part 2 includes fan case 7, motor 8, fan 9 and motor support 11.

Fan case 7 is a cover of air-sending part 2 and is made of resin. Fan case 7 is substantially cylindrical and has an opening on a bottom surface to take in air and another opening on a side surface to exhaust air. Fan case 7 is composed of scrolling section 7*a* and air outlet opening plate 31.

Scrolling section 7*a* forming a part of fan case 7 has an opening. A bottom surface of the opening is close to air inlet 4 of case 1, and air outlet 5*b* on a side surface of fan case 7 and air outlet 5 of case 1 are disposed on the same plane. A cross-sectional surface of scrolling section 7*a*, which is approximate cylindrical shape, has a round scroll shape. Scrolling section 7*a* includes fan 9. Scrolling section 7*a* has orifice 15 on the bottom surface of the opening, and air outlet opening plate 31 is disposed on the side surface having air outlet 5*b*.

Air outlet opening plate 31 is rectangular and has an opening, which is air outlet 5*b*. Air outlet opening plate 31 is disposed to partially block air outlet 5 of case 1. Air outlet opening plate 31 is provided with packing 43 around a downstream side of air outlet 5*b*.

An example of motor 8 is a DC motor having a rotational shaft and protruding toward air inlet 4. Motor 8 is attached around a center of motor support 11 with screws and/or any other fixing means and disposed on top plate 1*b* inside fan case 7. Power is supplied to motor 8 via an unillustrated electrical board to operate the rotational shaft of motor 8.

An example of fan 9 is a sirocco fan fixed to the rotational shaft. An activation of motor 8 and a rotation of the rotational shaft start fan 9 to transfer air. Air-sending part 2 directs air from air inlet 4 to air outlet 5.

Electrical board case 10 is composed of electrical board base 10*a* and electrical board cover 10*b*. Electrical board base 10*a* and electrical board cover 10*b* are both made of incombustible resin. The electrical board is attached to electrical board base 10*a* with screws and/or any other fixing means. Electrical board cover 10*b* is attached to electrical board base 10*a* with the same.

The electrical board is resultantly stored in electrical board case 10. Electrical board case 10 is attached close to fan case 7 with unillustrated screws and/or any other fixing means.

Motor support 11 partially forms a cover of air-sending part 2 and is made of metal or resin. Motor support 11 is disposed close to top plate 1*b* inside fan case 7 and is attached to fan case 7 with screws and/or any other fixing means.

Orifice 15 is formed at air inlet 4 of fan case 7 and has a cylindrical shape with a central portion open. Orifice 15 is disposed upstream air-sending part 2. Orifice 15 may be a separate component independent of fan case 7. In that case, the component is made of resin and is attached to an opening of fan case 7 with screws and/or any other fixing means.

Fan case 7 is attached to case 1 at a level lower than a center height of case 1 with screws and/or any other fixing means. In the embodiment, fan case 7 is attached to case 1 with an unillustrated connecting member. Motor support 11 may be attached to case 1 instead of fan case 7.

Packing 43 is a low-density resilient sealant made of foamed rubber and provided in a strip shape. Plural pieces of packing 43 are tightly applied around and downstream air outlet 5*b* in a rectangular shape. Hollow rectangular-shaped packing 43 may be otherwise applied around and downstream air outlet 5*b*.

Adapter set 3 forms at least part of the side surface of case 1 and disposed downstream air outlet 5*b*. Adapter set 3 includes power-connecting section 16, adapter plate 13 and duct-connecting adapter 14.

Power-connecting section 16 is erected downstream adapter plate 13 and is composed of base of power-connecting section 16*a* and cover of power-connecting section 16*b*. Ceiling-inserted fan 30 can be connected to an indoor power source wiring inside power-connecting section 16.

Base of power-connecting section 16*a* is a metal rectangular box with at least a side surface open.

Cover of power-connecting section 16*b* is also a metal rectangular box with at least a side surface open.

In the embodiment, base of power-connecting section 16*a* is fixed to adapter plate 13 with caulked joint. Cover of power-connecting section 16*b* is attached to base of power-connecting section 16*a* with screws and/or any other fixing means. Crimping, spot welding or any other method is also available for fixing base of power-connecting section 16*a* to adapter plate 13. However, in either case, it is preferable to have no machining marks or screw points protruding from adapter plate 13 toward air outlet 5 inside case 1.

Adapter plate 13 and duct-connecting adapter 14 are detailed later.

Figure 6:
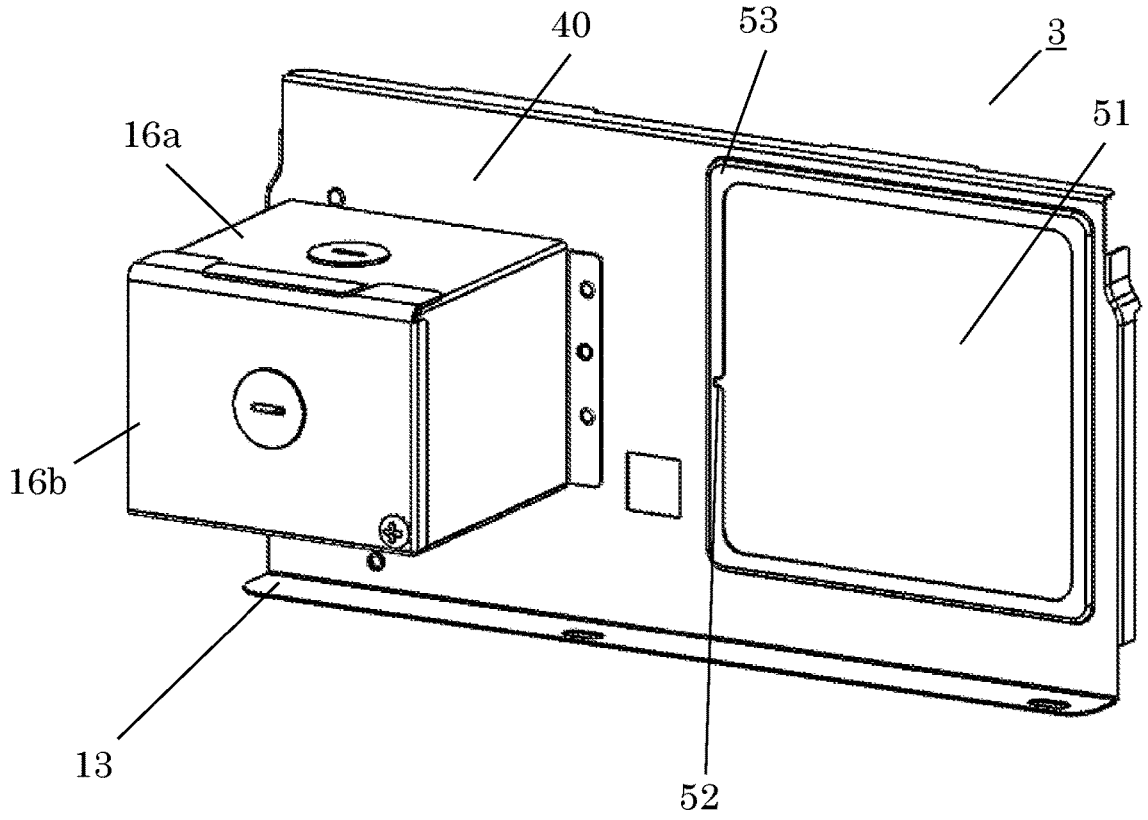
FIG. 6 is a perspective view of the adapter set with a duct-connecting adapter detached.
Figure 7:
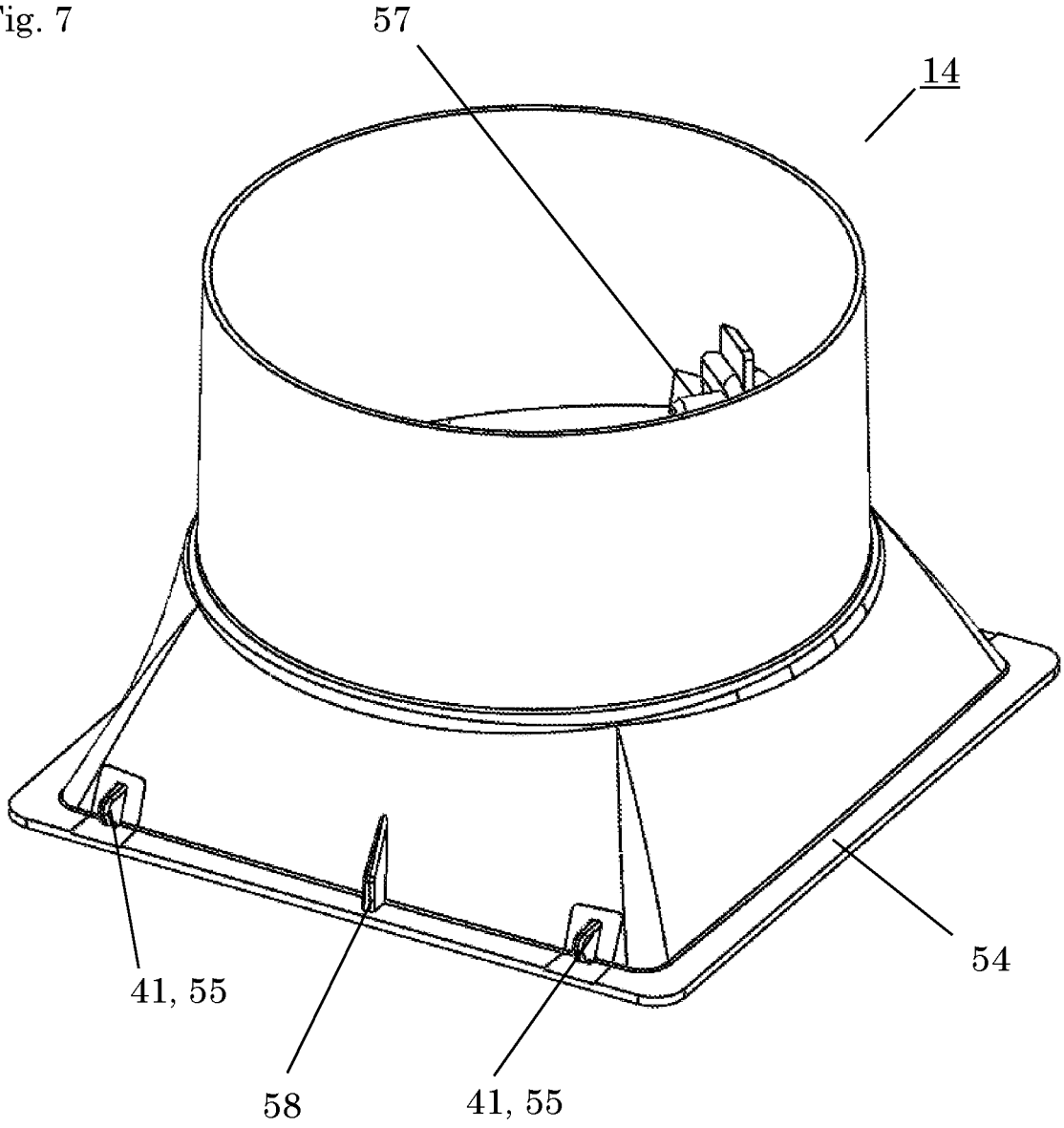
FIG. 7 is a side perspective view of a periphery of the duct-connecting adapter (first side locking section).
Figure 8:
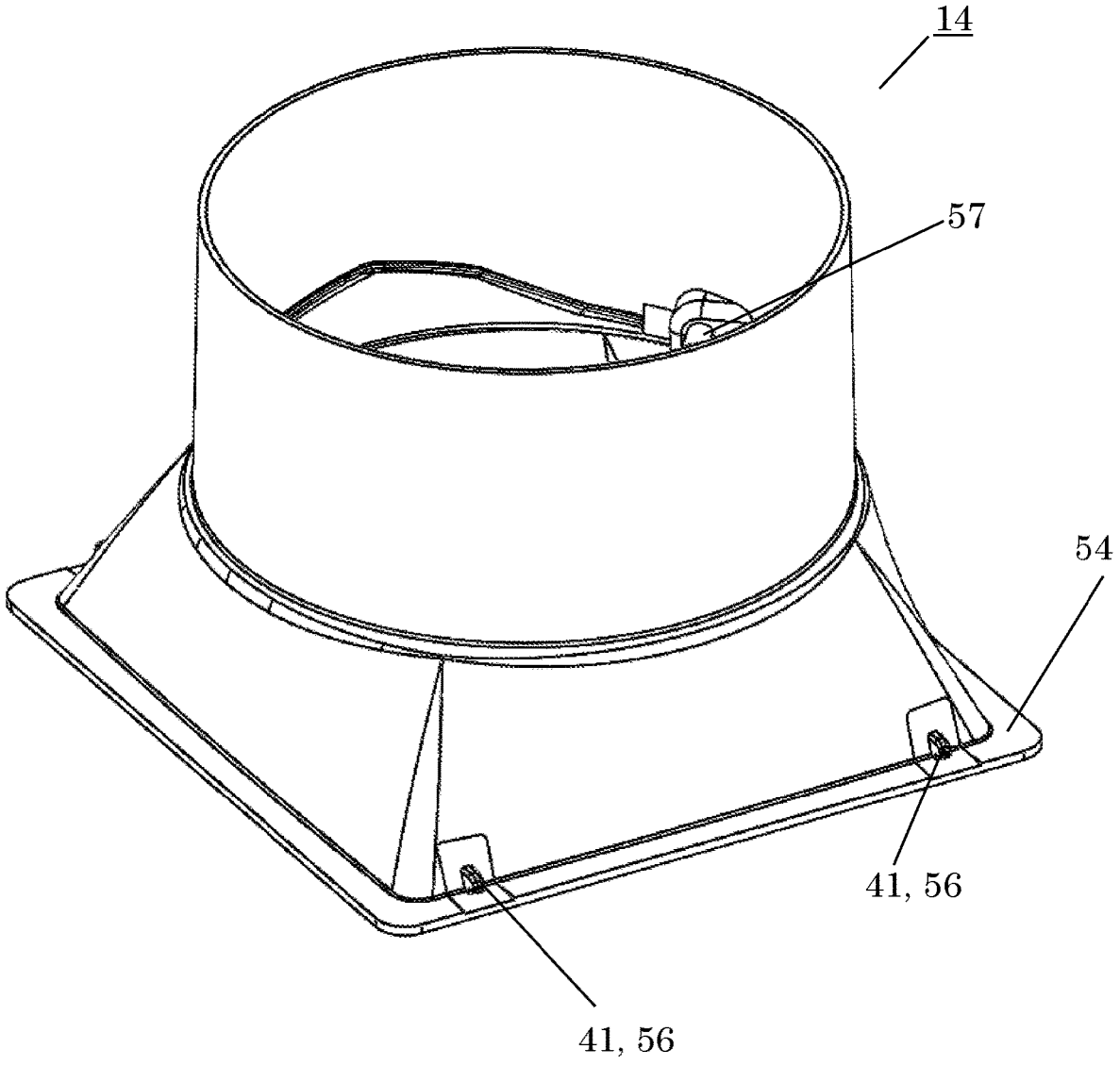
FIG. 8 is another side perspective view of the periphery of the duct-connecting adapter (second side locking section).
Figure 9:
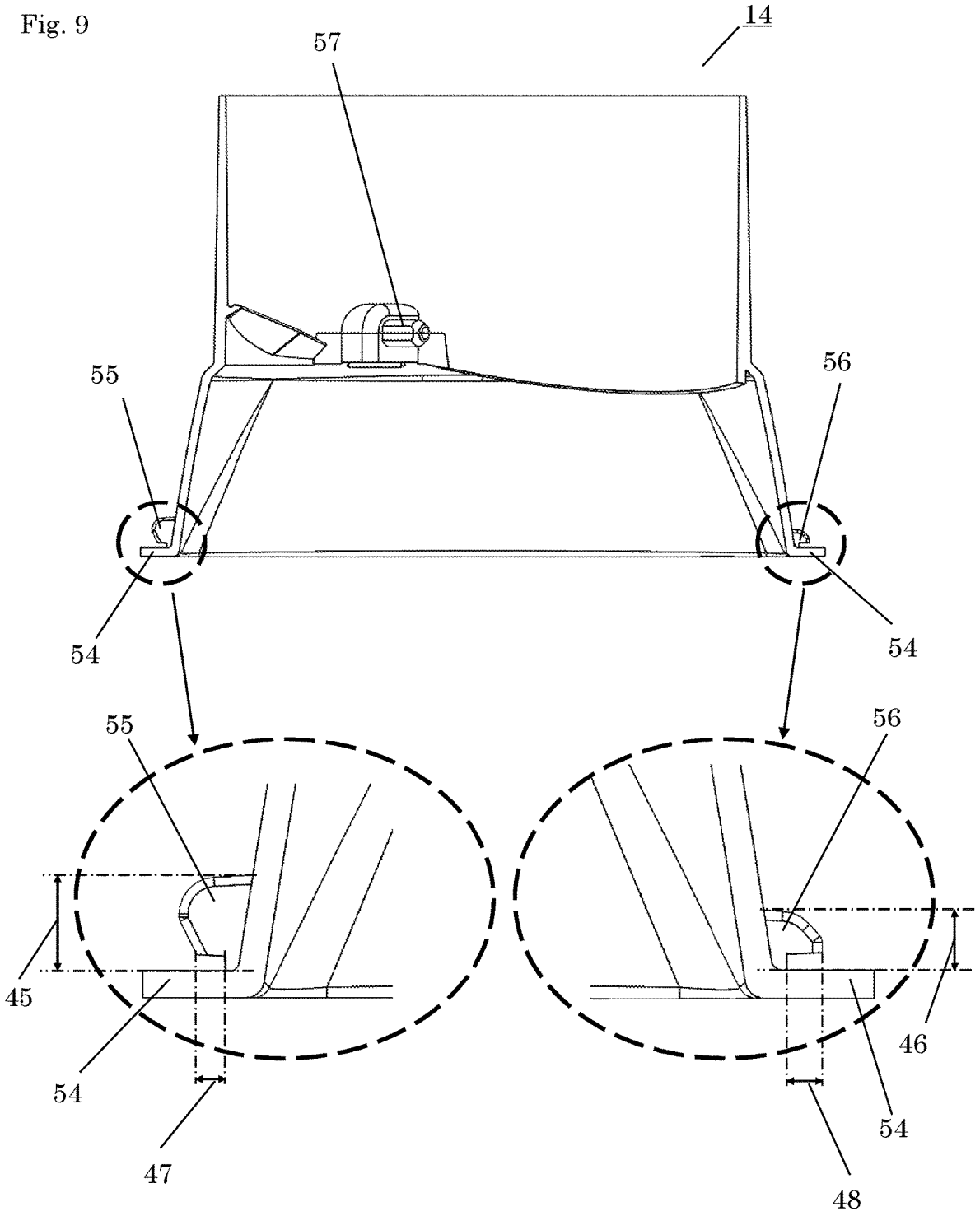
FIG. 9 is a cross-sectional view of the duct-connecting adapter.
Figure 10:
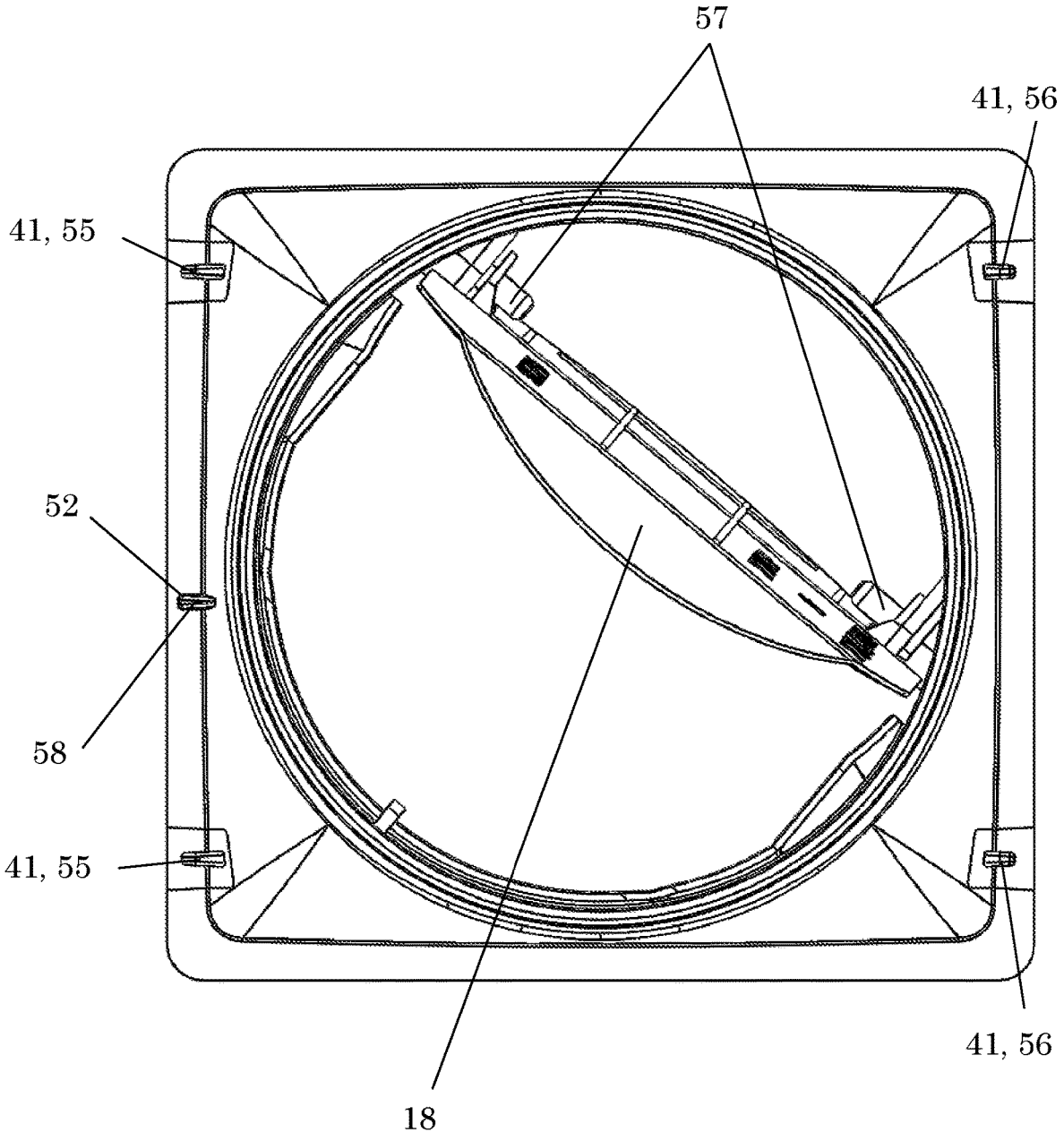
FIG. 10 illustrates a behavior of a shutter during an operation of the air-sending part.

Adapter plate 13 and duct-connecting adapter 14 constituting adapter set 3 are detailed with reference to FIG. 6, FIG. 7, FIG. 8, FIG. 9 and FIG. 10. FIG. 6 is a perspective view of adapter set 3 with duct-connecting adapter 14 detached. FIG. 7 is a side perspective view of a periphery of duct-connecting adapter 14 (first side locking section). FIG. 8 is another side perspective view of the periphery of duct-connecting adapter 14 (second side locking section). FIG. 9 is a cross-sectional view of duct-connecting adapter 14. FIG. 10 illustrates a behavior of shutter 18 during an operation of air-sending part 2.

Adapter plate 13 is a plane plate made of metal and has substantially the same size as that of the side surface of case 1. Adapter plate 13 is disposed downstream case 1, that is, on the side surface of case 1 with air outlet 5 disposed. Adapter plate 13 includes rectangular opening 51, first engaging section 52 and peripheral section 53.

Rectangular opening 51 is disposed on adapter plate 13. Rectangular opening 51 is disposed downstream air outlet 5*b* to communicate with each other.

First engaging section 52 is a cutout that is formed on peripheral section 53*a* and extends outward rectangular opening 51.

Peripheral section 53 is disposed around rectangular opening 51, in other words, peripheral section 53 forms rectangular opening 51. Peripheral section 53 slightly bulges downstream rectangular opening 51 from reference plane surface 40 of adapter plate 13. Reference plane surface 40 forms a large portion of adapter plate 13.

Duct-connecting adapter 14 is a hollow component erecting downstream adapter plate 13, which is rectangular upstream and cylindrical downstream. Duct-connecting adapter 14 is made of resin, particularly polypropylene resin with resilience and high abrasion resistance, for example. An inside space of duct-connecting adapter 14 is communicated with air outlet 5 to direct air inside from case 1. For example, connecting an indoor end of a duct communicated with outdoor to duct-connecting adapter 14 allows ceiling-inserted fan 30 to exhaust air.

Duct-connecting adapter 14 further includes sealing section 54, locking section 41, shaft 57, first engaged section 58 and shutter 18.

Sealing section 54 is integrally formed with duct-connecting adapter 14 and is provided as a flange, which further extends outward from a rectangular periphery of duct-connecting adapter 14. Sealing section 54 is substantially the same shape as peripheral section 53 of adapter plate 13. As such, a downstream surface of sealing section 54 closely contacts with peripheral section 53, which is bulged.

First side locking sections 55, which are part of locking section 41, are integrally formed with duct-connecting adapter 14. First side locking sections 55 are stops that further project outward from the periphery of duct-connecting adapter 14. Specifically, two first side locking sections 55 are disposed each close to both ends on a specified side of duct-connecting adapter 14. A gap is provided between first side locking sections 55 and the downstream surface of sealing section 54. A width of the gap is nearly equal to or slightly wider than a thickness of peripheral section 53. Peripheral section 53 is held by first side locking sections 55 and sealing section 54.

Second side locking sections 56, which are another part of locking section 41, are integrally formed with duct-connecting adapter 14. Second side locking sections 56 are stops that further project outward from the periphery of duct-connecting adapter 14. Specifically, two second side locking sections 56 are provided each close to both ends on another specified side of duct-connecting adapter 14. The gap is provided between second side locking sections 56 and the downstream surface of sealing section 54. The width of the gap is nearly equal to or slightly wider than the thickness of peripheral section 53. Peripheral section 53 is held by second side locking sections 56 and sealing section 54.

Duct-connecting adapter 14 is removably attached to peripheral section 53 of adapter plate 13 by sealing section 54 and locking section 41, specifically, sealing section 54 and first side locking sections 55, and sealing section 54 and second side locking sections 56.

Here, first side locking sections 55 are compared with second side locking sections 56, in a cross-sectional view, the stops of first side locking sections 55 are larger than those of second side locking sections 56, this means, height of first side locking section 45 is higher than height of second side locking section 46. Or height of second side locking section 46 is lower than height of first side locking sections 45. Specifically, height of first side locking section 45 is 5 mm and height of second side locking section 46 is 3 mm in the embodiment. In addition, in the cross-sectional view, for first side locking sections 55, depth of first side locking section 47 is shallower than depth of second side locking section 48. Or, for second side locking sections 56, depth of second side locking section 48 is deeper than depth of first side locking section 47. Specifically, depth of first side locking section 47 is 1.5 mm and depth of second side locking section 48 is 1.8 mm in the embodiment. This configuration improves workability to engage duct-connecting adapter 14 with adapter plate 13. The configuration is detailed later.

Shafts 57 are protrusions to attach shutter 18 and are integrally formed with duct-connecting adapter 14. Specifically, two shafts 57 protrude from an inside wall of duct-connecting adapter 14 toward the inside space and are coaxially disposed and oppose with each other inside duct-connecting adapter 14. Shafts 57 have an acute angle to at least a side forming rectangular opening 51, in other words, shafts 57 are not perpendicular or parallel to any of four sides forming the same. Shafts 57 disposed coaxially serve as a rotating shaft of shutter 18.

First engaged section 58 is a protrusion integrally formed with duct-connecting adapter 14, which further protrudes outward from the periphery of duct-connecting adapter 14. First engaged section 58 is engaged with first engaging section 52, which is a cutout to attach duct-connecting adapter 14 to adapter plate 13. First engaged section 58 is provided between two first side locking sections 55.

Shutter 18 is a plate made of resin and disposed in the inside space of duct-connecting adapter 14. Shutter 18 opens and closes an air path formed in the inside space. Shutter 18 closes a cylindrical opening of duct-connecting adapter 14 during air-sending part 2 is not in operation. The cylindrical opening is closed by an own weight of shutter 18 and/or a wind pressure of contrary wind from a downstream side. Shutter 18 opens the cylindrical opening not to block an exhaust air from inside case 1 during air sending part 2 is in operation. The cylindrical opening is opened by a wind pressure of exhaust air. To smoothly open and close shutter 18 regardless of whether air-sending part 2 is in operation or not, shutter 18 is desirably attached to shafts 57 as far as possible from a center of shutter 18.

Figure 11:
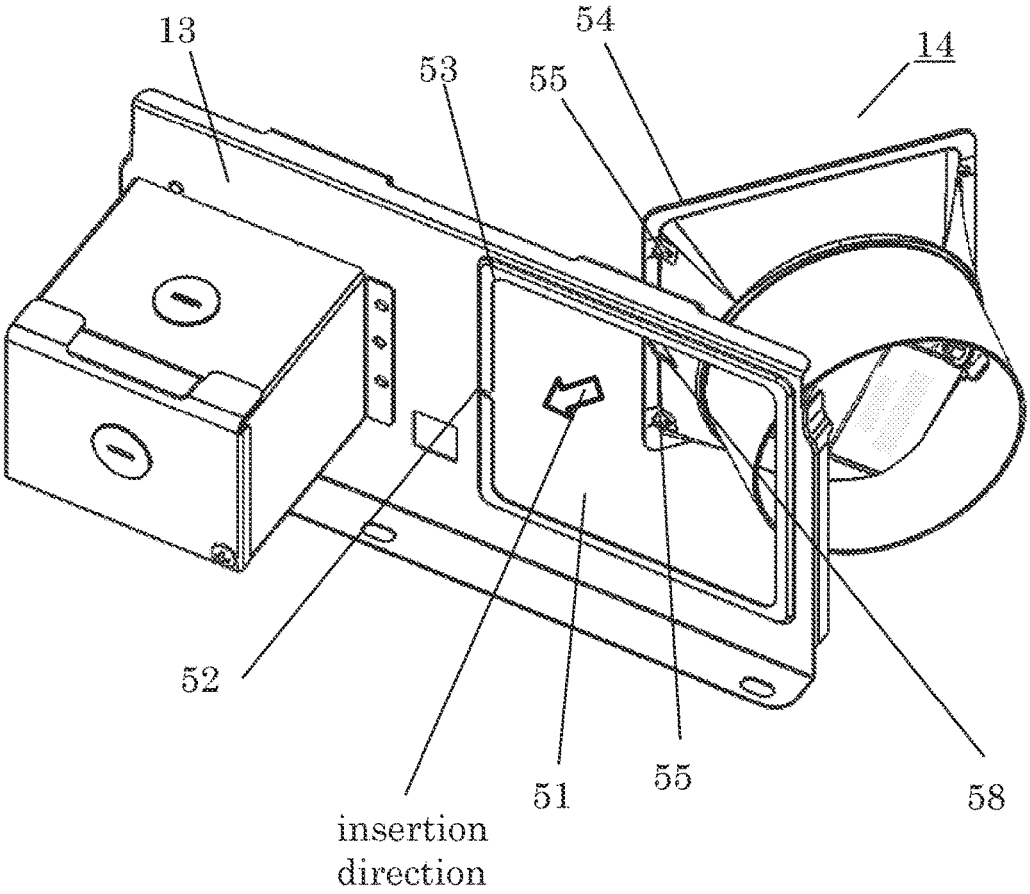
FIG. 11 is a perspective view of an insertion direction to attach the duct-connecting adapter to an adapter plate.
Figure 12:
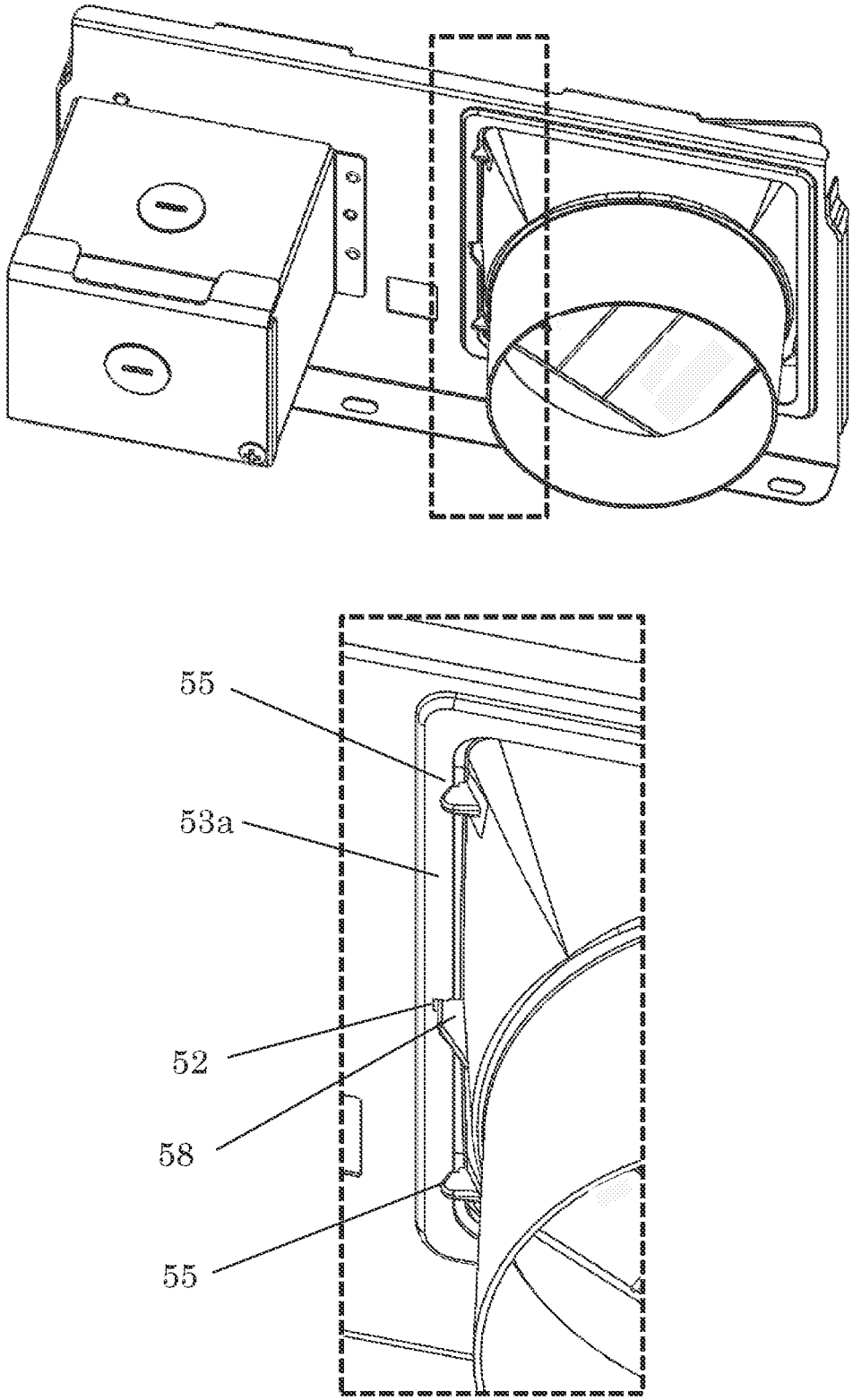
FIG. 12 is a perspective view with first side locking sections locked to a peripheral section.
Figure 13:
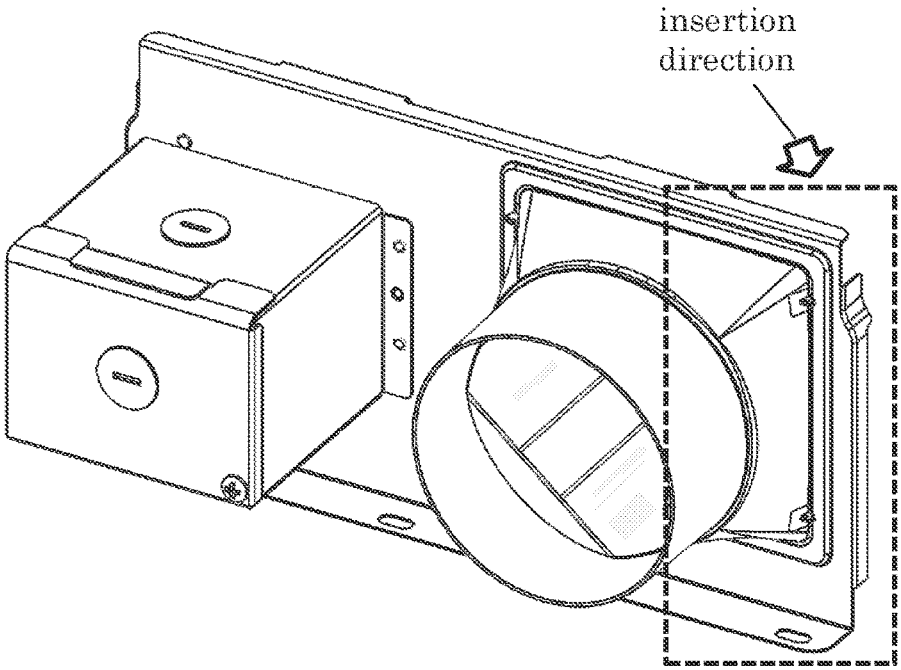
FIG. 13 is a perspective view with second side locking sections locked to the peripheral section.
Figure 13:
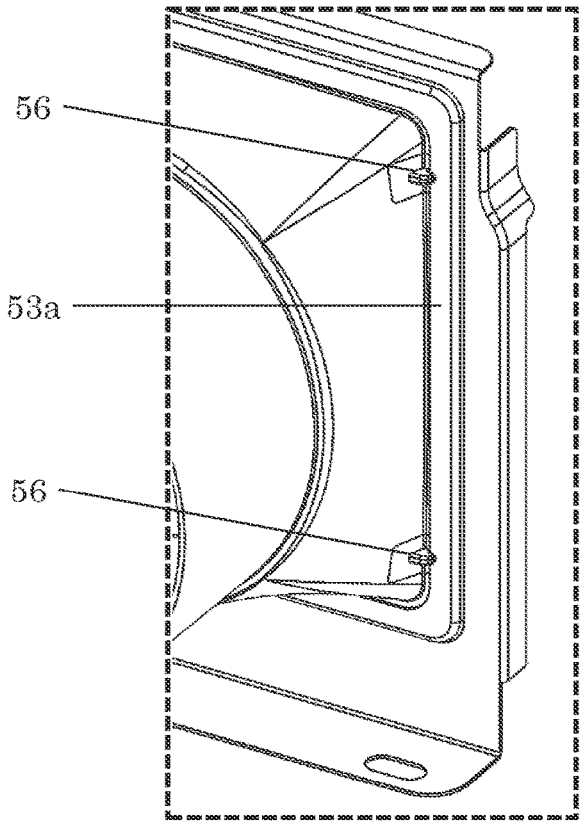
Figure 14:
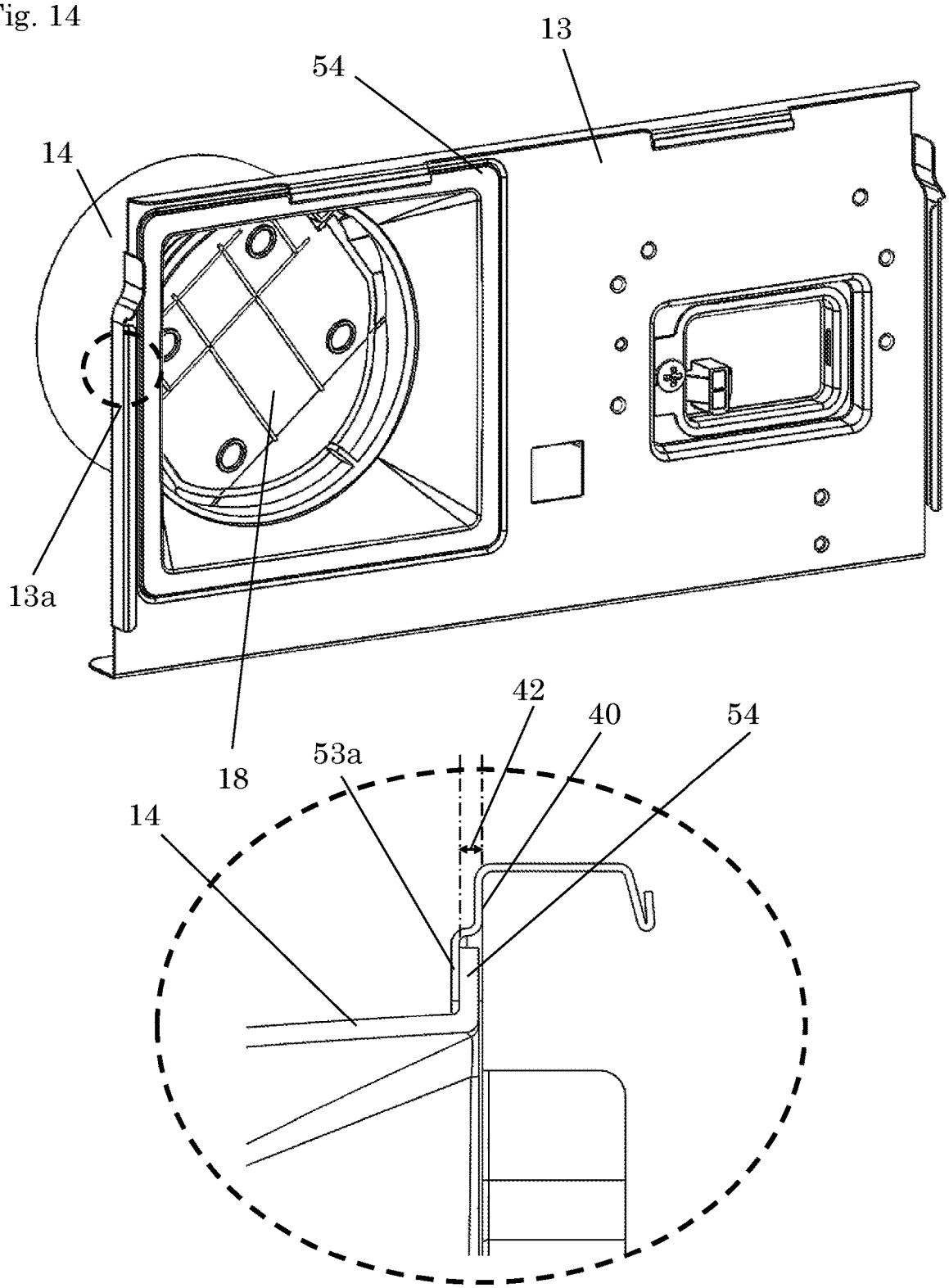
FIG. 14 is a perspective view and a cross-sectional view of a positional relation between a sealing section and the peripheral section with the adapter set assembled.

A procedure to attach duct-connecting adapter 14 to adapter plate 13 is explained with reference to FIG. 11, FIG. 12, FIG. 13 and FIG. 14. FIG. 11 is a perspective view of an insertion direction to attach duct-connecting adapter 14 to adapter plate 13. FIG. 12 is a perspective view with first side locking sections 55 locked to peripheral section 53. FIG. 13 is a perspective view with second side locking sections 56 locked to peripheral section 53. FIG. 14 is a perspective view and a cross-sectional view of a positional relation between sealing section 54 and peripheral section 53 with adapter set 3 assembled.

As indicated in FIG. 11, duct-connecting adapter 14 is inserted to rectangular opening 51 of adapter plate 13 in an oblique direction from an upstream side. The protrusion of first engaged section 58 is first engaged with first engaging section 52, which is the cutout, then, duct-connecting adapter 14 is properly positioned. In the embodiment, shafts 57 are not perpendicular or parallel to any of the four sides forming rectangular opening 51, therefore, duct-connecting adapter 14 has a certain attaching direction. Even so, first engaging section 52 and first engaged section 58 are provided only one each, therefore, it's possible to prevent a wrong assembly, for example, duct-connecting adapter 14 is attached to adapter plate 13 upside down.

After duct-connecting adapter 14 is positioned, as indicated in FIG. 13, sealing section 54 of duct-connecting adapter 14 is shifted to be parallel to reference plane surface 40 of adapter plate 13. Accordingly, first side locking sections 55 are shifted to a downstream side of peripheral section 53, peripheral section 53 is held by first side locking sections 55 and sealing section 54.

While peripheral section 53 is held by first side locking sections 55 and sealing section 54, as indicated in FIG. 13, second side locking sections 56 are pressed to get over peripheral section 53 and then the stops of second side locking sections 56 are shifted downstream peripheral section 53. Accordingly, peripheral section 53 is held by second side locking sections 56 and sealing section 54. Second side locking sections 56 are removably engaged with peripheral section 53 without adverse deformation and/or any other defects in assembling. This is because second side locking sections 56 are made of resilient resin, and height of second side locking section 46 is lower than height of first side locking section 45 compared to first side locking sections 55.

As indicated in FIG. 14, a thickness of sealing section 54 is slightly smaller compared with height 42, which is generated by bulging peripheral section 53 downstream from reference plane surface 40. In the embodiment, the height of sealing section 54 is 1.5 mm and height 42 is 1.8 mm. Because of the difference in height, sealing section 54 does not protrude upstream reference plane surface 40 during duct-connecting adapter 14 is engaged with adapter plate 13.

Figure 15:
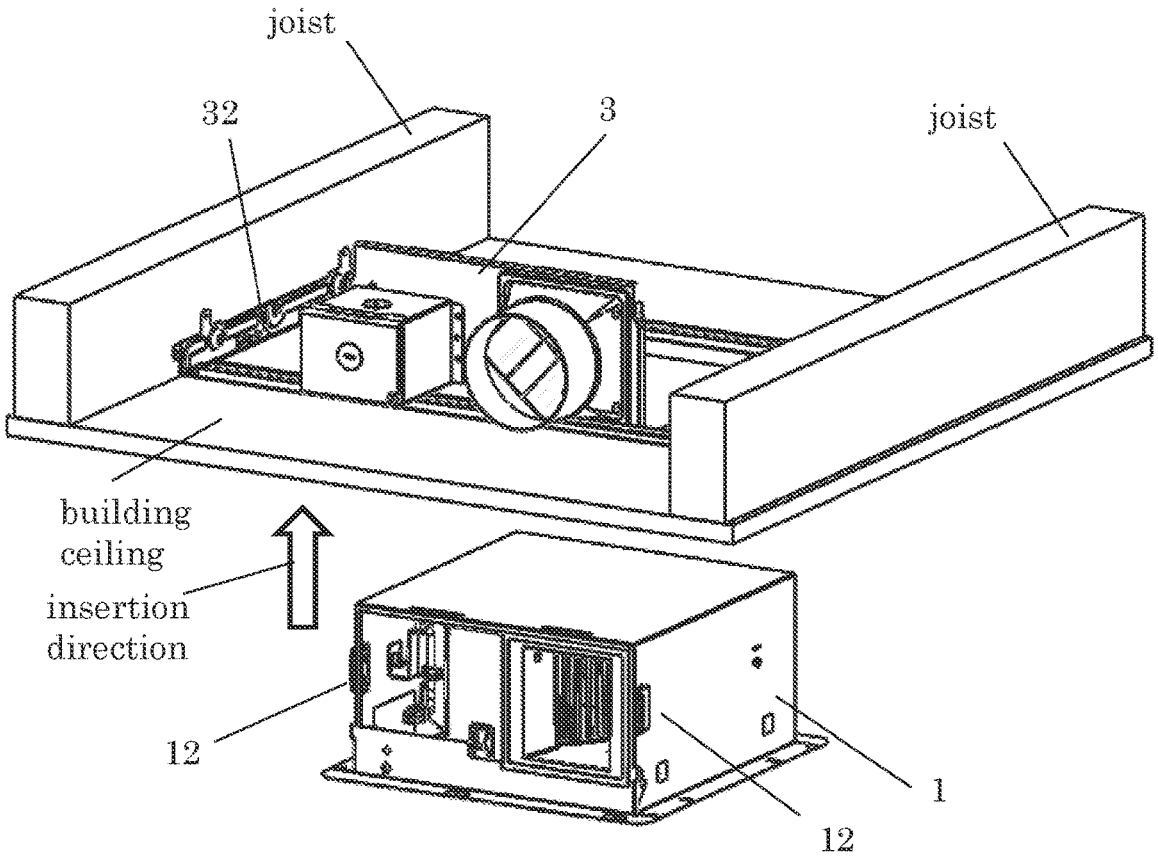
FIG. 15 is a perspective view of an exemplary procedure to install the ceiling-inserted fan to a ceiling.

An example of a procedure to install a ceiling-inserted fan is explained with reference to FIG. 15. An opening is provided on an existing ceiling board in the example. FIG. 15 is a perspective view of an exemplary procedure to install the ceiling-inserted fan to a ceiling.

Mounting bracket 32 is used to install ceiling-inserted fan 30 to the opening provided on the existing ceiling board.

Mounting bracket 32 is a non-step length-adjustment component made of metal, which is extendable from 11 to 25 inches, for example. Mounting bracket 32 is fixed to each of opposed joists first with screws and/or any other fasteners, then adapter set 3 is fixed to mounting bracket 32 with the same. Subsequently, case 1 is installed to adapter set 3 fixed on mounting bracket 32 with the same from below.

To install case 1 to adapter set 3, each of guide members 12 disposed on each of adjacent side surfaces 1*a* of case 1 is engaged with each of guide supporting sections 13*a* disposed on adapter plate 13 and then case 1 is slid upward. Duct-connecting adapter 14 and shutter 18 are disposed downstream reference plane surface 40. As such, including screws and any other fasteners, there are no portions protruding toward case 1 from reference plane surface 40. As described above, air outlet 5*b* is provided with packing 43. Packing 43 is pressed against an upstream side of sealing section 54. Then, it's possible to provide ceiling-inserted fan 30 with no gap between case 1 and adapter set 3.

The ceiling-inserted fan with the above-described configuration can solve issues such as air leakage due to a gap between an adapter and an adapter plate or poor workability in sliding and fitting the case of the fan to the adapter plate.

Second Embodiment

Figure 16:
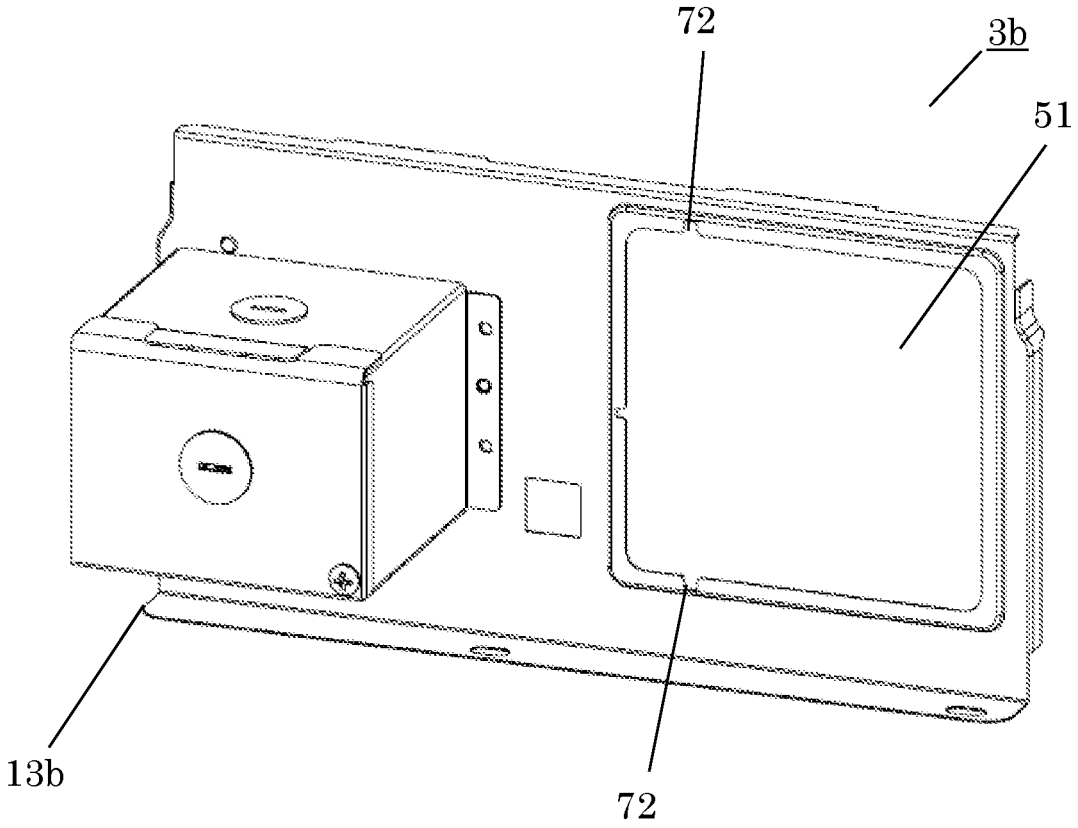
FIG. 16 is a perspective view of an adapter set with a duct-connecting adapter detached in accordance with an embodiment 2.
Figure 17:
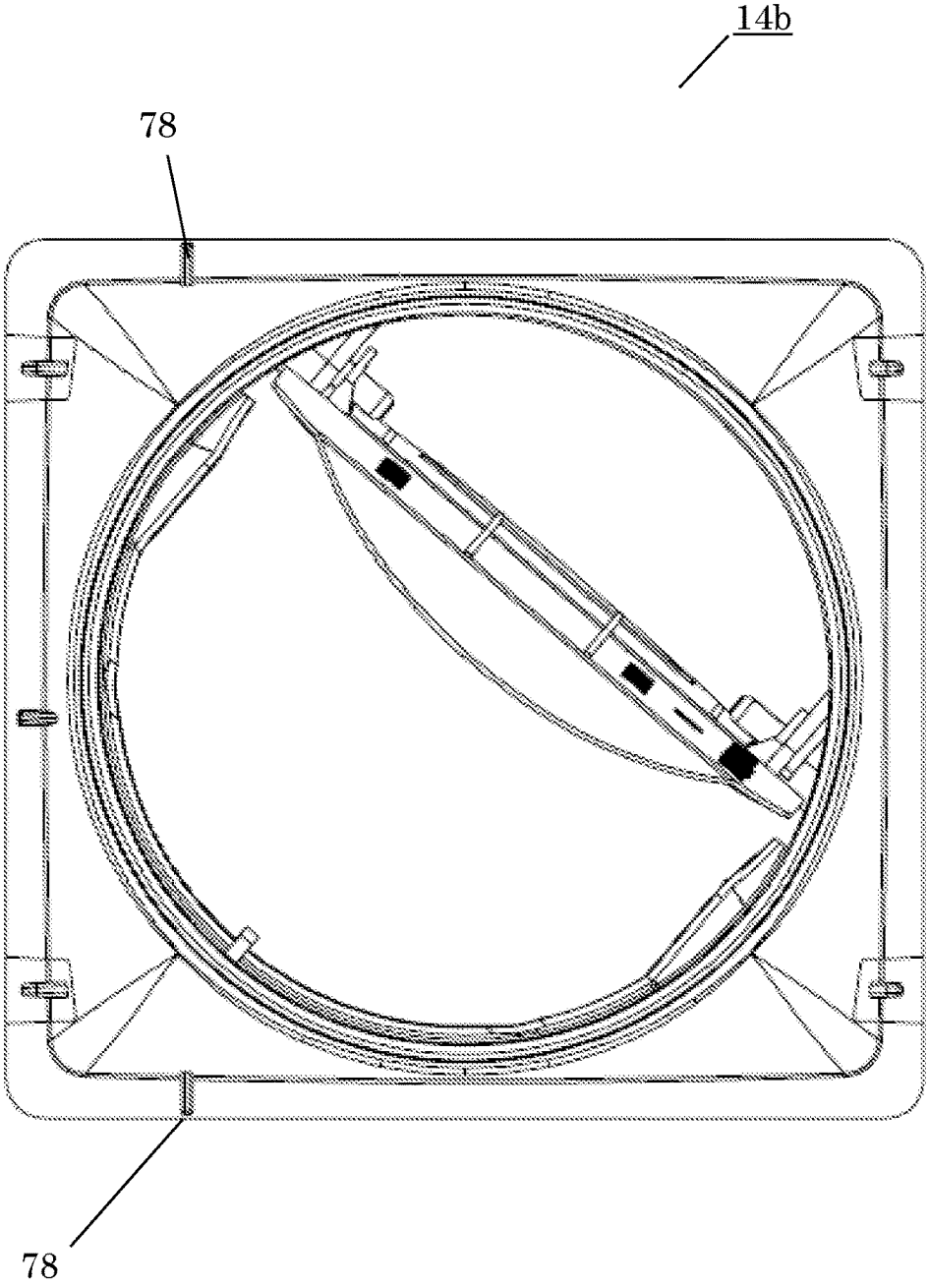
FIG. 17 illustrates a behavior of a shutter during an operation of an air-sending part in accordance with the embodiment 2.
Figure 18:
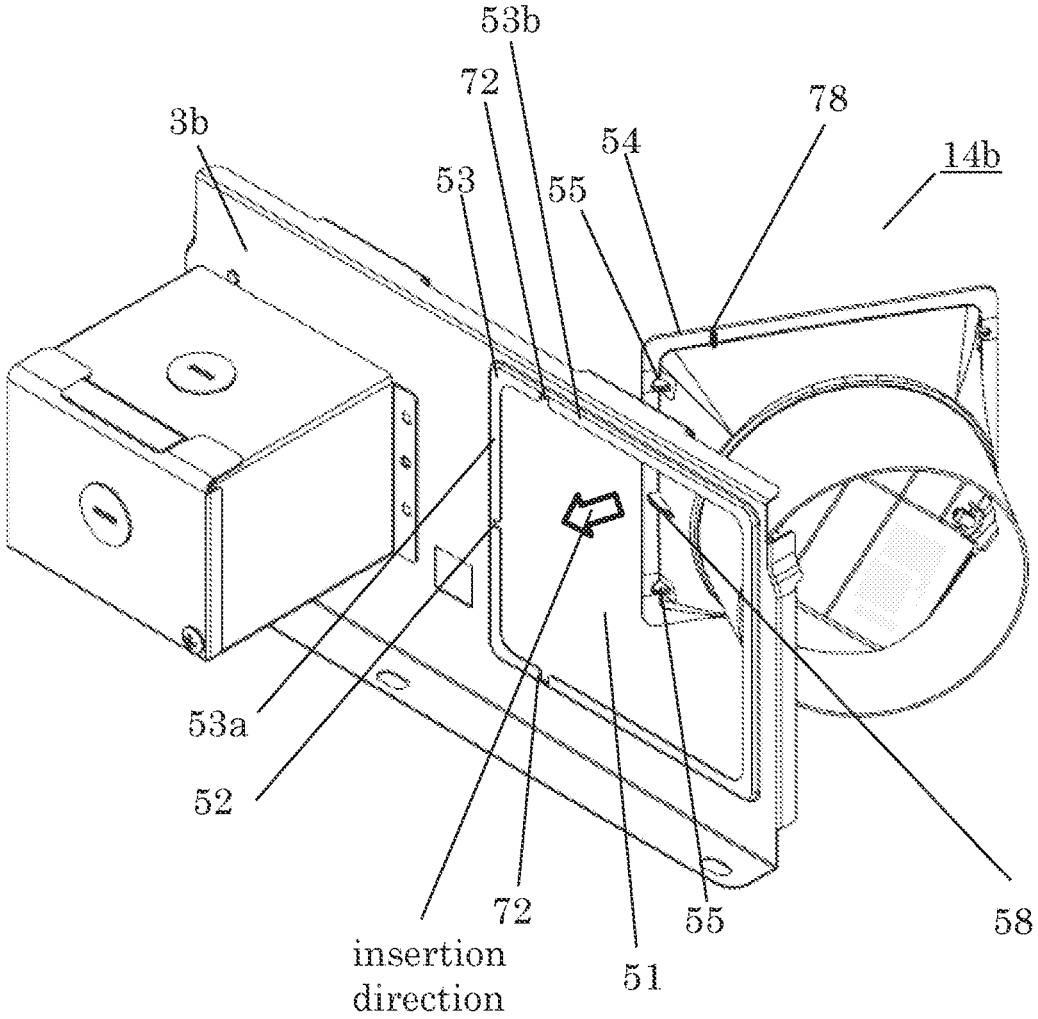
FIG. 18 is a perspective view of an insertion direction to attach a duct-connecting adapter to an adapter plate in accordance with the embodiment 2.
Figure 19:
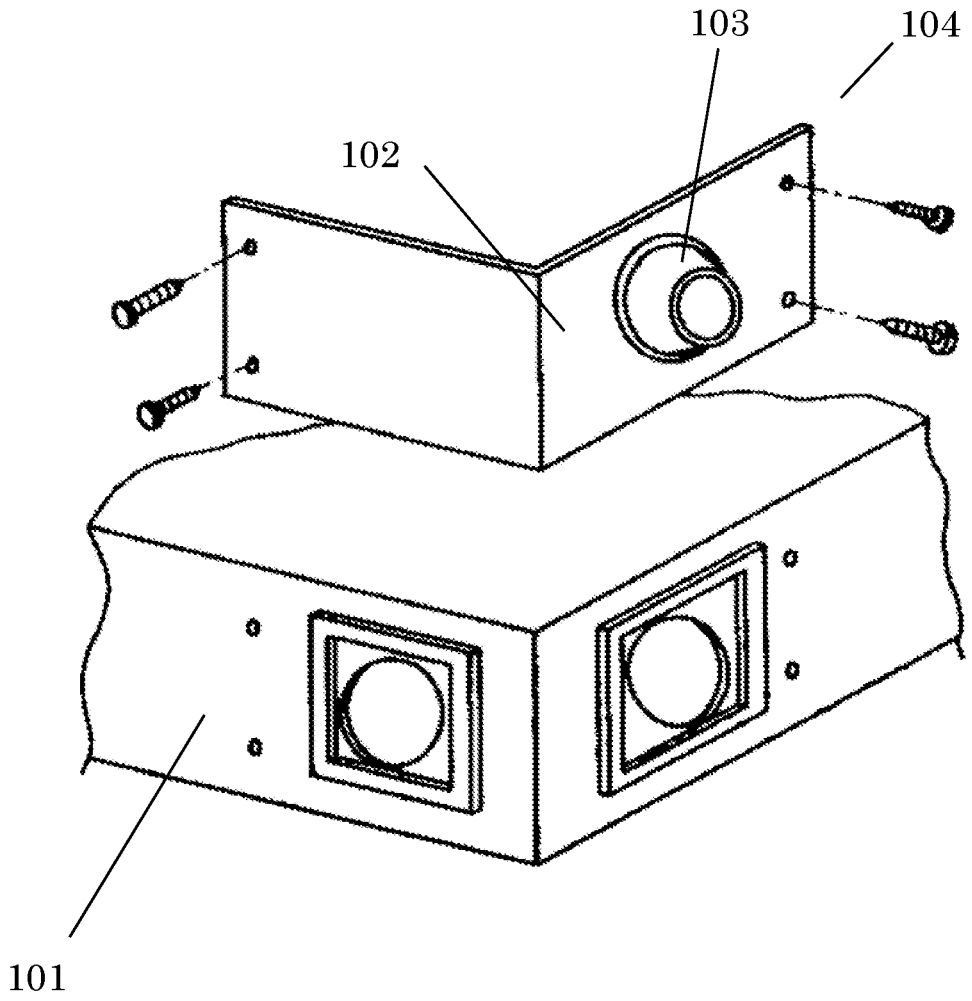
FIG. 19 is a detail drawing of a conventional ceiling-inserted fan.
Figure 20:
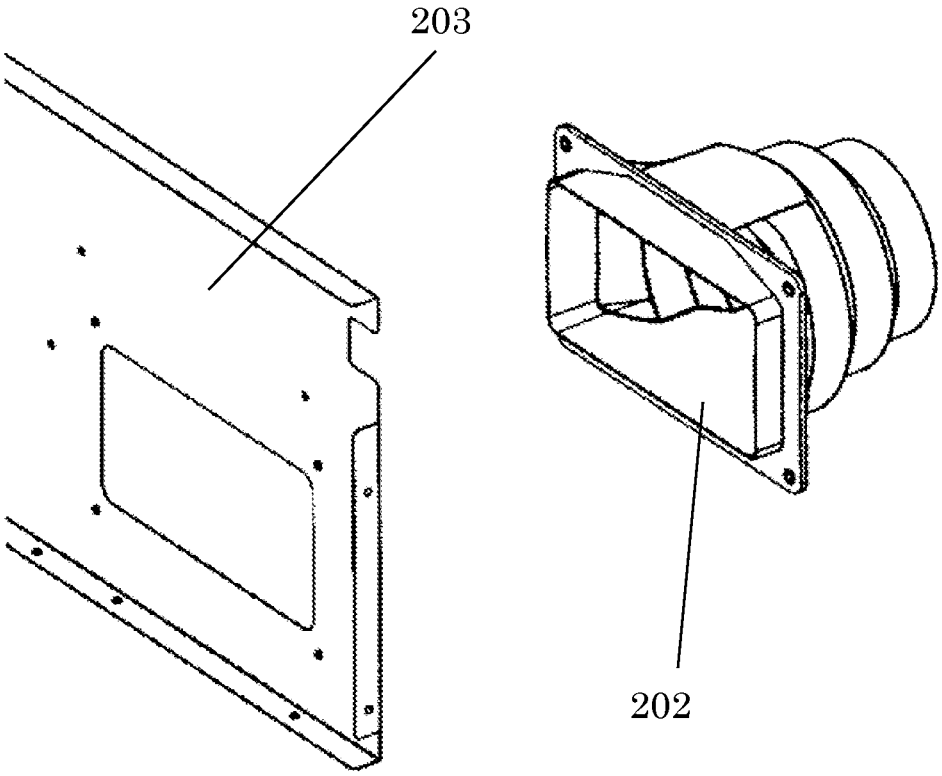
FIG. 20 is a detail drawing of another conventional ceiling-inserted fan.

A structure of ceiling-inserted fan 30*b* in accordance with an embodiment 2 of the present invention is explained with reference to FIG. 16, FIG. 17 and FIG. 18. FIG. 16 is a perspective view of an adapter set with a duct-connecting adapter detached in accordance with the embodiment 2. FIG. 17 illustrates a behavior of a shutter during an operation of an air-sending part in accordance with the embodiment 2. FIG. 18 is a perspective view of an insertion direction to attach the duct-connecting adapter to an adapter plate in accordance with the embodiment 2.

Ceiling-inserted fan 30*b* in accordance with the embodiment 2 of the present invention includes case 1, air-sending part 2 and adapter set 3*b*. Other components referred to in the embodiment 2 are the same as those of an embodiment 1. However, the embodiment 2 is different from the embodiment 1 in that duct-connecting adapter 14*b*, which is a part of adapter set 3*b*, has second engaged sections 78, and adapter plate 13*b* has second engaging sections 72.

Adapter set 3*b* includes power-connecting section 16, adapter plate 13*b* and duct-connecting adapter 14*b*.

Adapter plate 13*b* is disposed downstream a side surface of case 1 with air outlet 5 disposed. Adapter plate 13*b* includes rectangular opening 51, first engaging section 52, peripheral section 53 and second engaging sections 72.

Duct-connecting adapter 14*b* includes sealing section 54, locking section 41, shaft 57, first engaged section 58, shutter 18 and second engaged sections 78.

Second engaging sections 72 are cutouts formed on peripheral section 53, specifically, on peripheral section 53*b* adjacent to peripheral section 53*a* where first engaging section 52 is provided. The cutouts extend outward rectangular opening 51.

Second engaged sections 78 are integrally formed with duct-connecting adapter 14*b*, which are protrusions provided on a periphery of duct-connecting adapter 14*b*. Second engaged sections 78 are engaged with second engaging sections 72 (cutouts) in attaching duct-connecting adapter 14*b* to adapter plate 13*b*. Second engaged sections 78 are provided on side surfaces adjacent to a side surface where first engaged section 58 is provided. The protrusions of second engaged sections 78 are engaged with second engaging sections 72 (cutouts). First side locking sections 55 are locked to peripheral section 53*a*, then second side locking sections 56 are locked to peripheral section 53*a*. When a protruding width of first engaged section 58 is equal to each of those of second engaged sections 78, it's preferable to make a width of second engaging sections 72 (cutouts) slightly larger than that of first engaging section 52.

In the embodiment 2, second engaging sections 72 are provided on each of peripheral sections 53*b* adjacent to peripheral section 53*a* where first engaging section 52 is provided, and second engaged sections 78 are provided on each of the side surfaces adjacent to the side surface where first engaged section 58 is provided.

Thus, duct-connecting adapter 14*b* can be attached to adapter plate 13*b* more accurately. As such, the embodiment 2 reliably prevents unexperienced contractors from wrongly attaching the duct-connecting adapter to the adapter plate upside down, for example.

INDUSTRIAL APPLICABILITY

A ceiling-inserted fan in accordance with the present invention, where an adapter is separated from a case of the fan, is useful because the ceiling-inserted fan can prevent air leakage into an attic without loss of workability.

REFERENCE MARKS IN THE DRAWINGS

1 case
1*a* adjacent side surface
1*b* top plate
3, 3*b* adapter set
4 air inlet
5, 5*b* air outlet
6 exhaust path
7 fan case
7*a* scrolling section
8 motor
9 fan
10 electrical board case
10*a* electrical board base
10*b* electrical board cover
11 motor support
12 guide member
13, 13*b* adapter plate
13*a* guide supporting section
14, 14*b* duct-connecting adapter
15 orifice
16 power-connecting section
16*a* base of power connecting section
16*b* cover of power connecting section
17 concave shape
18 shutter
22 bulging section
30, 30*b* ceiling-inserted fan
31 air outlet opening plate
32 mounting bracket
40 reference plane surface
41 locking section
42 height
43 packing
45 height of first side locking section
46 height of second side locking section
47 depth of first side locking section
48 depth of second side locking section
51 rectangular opening
52 first engaging section
53, 53*a*, 53*b* peripheral section
54 sealing section
55 first side locking section
56 second side locking section
57 shaft
58 first engaged section
72 second engaging section
78 second engaged section

The invention claimed is:

1. A ceiling-inserted fan comprising:

a case having an air inlet on a bottom surface of the case and an air outlet on a side surface of the case;

an adapter plate having a rectangular opening and forming at least part of the side surface of the case;

a duct-connecting adapter protruding from the adapter plate outward the case; and an air-sending part for directing air from the air inlet to the air outlet, wherein the duct-connecting adapter is separated from the adapter plate, the duct-connecting adapter includes a sealing section that contacts with a peripheral section of the rectangular opening, the sealing section being located in the case, and a locking section that contacts with the peripheral section, the locking section being located outside of the case, and the peripheral section is removably attached to the duct-connecting adapter by the sealing section and the locking section.

2. The ceiling-inserted fan according to claim 1, wherein the locking section is provided for each of two opposed sides of the peripheral section of the rectangular opening, and the locking section and the sealing section removably attach the two opposed sides of the peripheral section.

3. The ceiling-inserted fan according to claim 1, wherein the locking section is provided for each of the two opposed sides of the peripheral section of the rectangular opening, and a height of the locking section from the duct-connecting adapter provided for a first side of the peripheral section is higher than another height of the locking section from the duct-connecting adapter provided for a second side of the peripheral section.

4. The ceiling-inserted fan according to claim 2, wherein the adapter plate includes a first engaging section on the peripheral section of the rectangular opening to unidirectionally position the duct-connecting adapter to the rectangular opening, and the duct-connecting adapter includes a rotating shaft having an acute angle to a side forming the rectangular opening in an inside space, a shutter that opens and closes an air path formed in the inside space by a rotation of the rotating shaft and a first engaged section engaged with the first engaging section to be unidirectionally positioned to the rectangular opening.

5. The ceiling-inserted fan according to claim 4, wherein the first engaged section is provided on a same side as the locking section.

6. The ceiling-inserted fan according to claim 1, wherein the locking section contains a resilient material.

7. The ceiling-inserted fan according to claim 4, wherein the adapter plate includes second engaging sections each provided on another two opposed sides of the peripheral section adjacent to the two opposed sides of the peripheral section to unidirectionally position the duct-connecting adapter to the peripheral section of the rectangular opening, and the duct-connecting adapter includes second engaged sections engaged with the second engaging sections to be unidirectionally positioned to the peripheral section of the rectangular opening.

* * * * *